United States Patent [19]

Klingbeil

[11] 4,236,711

[45] Dec. 2, 1980

[54] MAGICIAN'S WALKING CANE SNAKE

[76] Inventor: Karl Klingbeil, Rte. 2, Tigertown, Wis. 54486

[21] Appl. No.: 65,042

[22] Filed: Aug. 9, 1979

[51] Int. Cl.[3] ..... A63J 21/00; A45B 9/00

[52] U.S. Cl. ..... 272/8 R; 46/123; 135/74

[58] Field of Search ..... 272/8 R, 8 D, 8 N, 9, 272/21; 46/123, 119, 120; 135/65, 66, 74, 75, 17, 16; 119/96, 29

[56] References Cited

U.S. PATENT DOCUMENTS

| | | | |
|---|---|---|---|
| Re. 28,067 | 7/1974 | Hyman | 135/74 |
| 143,248 | 9/1873 | Pevey | 135/65 |
| 297,006 | 4/1884 | Rand | 135/65 X |
| 1,049,345 | 1/1913 | Dolman | 46/123 |
| 1,324,646 | 12/1919 | Clements | 46/123 |
| 1,522,427 | 1/1925 | Farruggio | 135/65 |
| 1,601,983 | 10/1926 | Savage | 46/123 |
| 2,830,402 | 4/1958 | Schleich | 46/123 X |
| 3,061,572 | 10/1962 | Packer | 46/123 X |
| 3,097,446 | 7/1963 | Packer | 46/123 |
| 3,380,184 | 4/1968 | Fernandez | 46/123 X |

FOREIGN PATENT DOCUMENTS

| | | | |
|---|---|---|---|
| 197983 | 3/1954 | Austria | 135/74 |
| 929535 | 6/1955 | Fed. Rep. of Germany | 46/123 |
| 11219 | of 1891 | United Kingdom | 135/77 |
| 799967 | 8/1958 | United Kingdom | 46/123 |

*Primary Examiner*—Richard C. Pinkham
*Assistant Examiner*—Arnold W. Kramer
*Attorney, Agent, or Firm*—Victor J. Evans & Co.

[57] ABSTRACT

Disclosed herein is a device that can be used as a magician's prop that in one instance functions as a rigid walking stick or cane, but when released and actuated becomes coiled upon the floor and takes on the appearance of a snake with its head raised. This is accomplished by means of an inner core structure that is comprised of a series of disc like segments strung on a thin cable in a bead like fashion leading to a lever device disguised in the head that when compressed and latched draws the cable taunt compressing the discs one upon another causing the entire length of the body to become rectilinear and rigid in the form of a cane. In the head of the cane the latching device maintains the tension drawn on the cable; however, when unlatched the tension subsides, the discs separate a discrete distance and its body becomes flexible. The entire body is covered with an elastic outer skin that is affixed to the body while the body is in a flexible coiled posture so that the membrane has a memory and the body returns to that coiled posture when the cable tension is released.

4 Claims, 4 Drawing Figures

FIG. 1
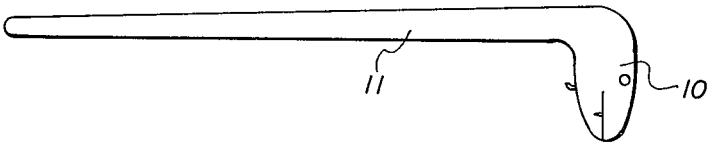
FIG. 2
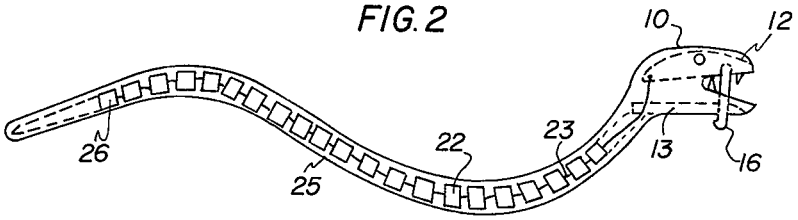
FIG. 4
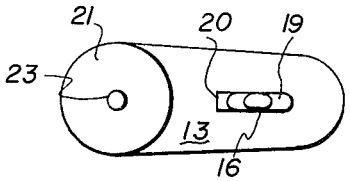
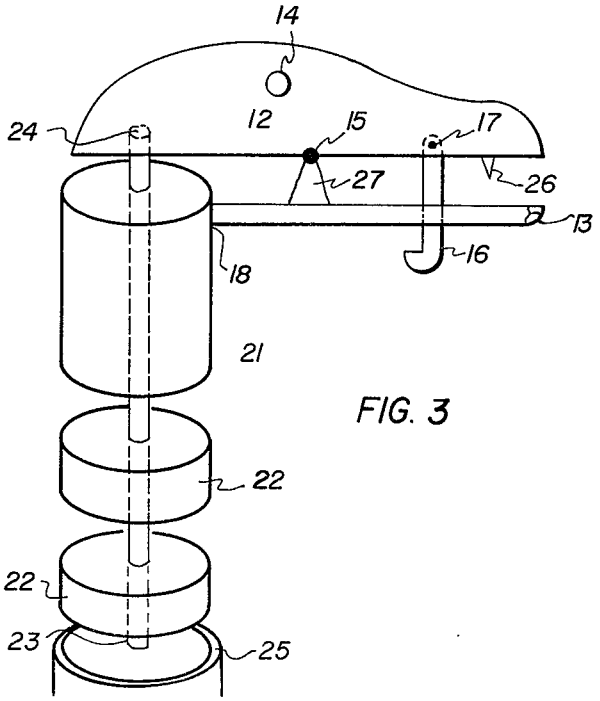
FIG. 3

MAGICIAN'S WALKING CANE SNAKE

BACKGROUND OF THE INVENTION

The use of a cable or string to link the various members of the segmented body of a toy snake or the like is well known in the prior art. With a cable at the core the body is quite flexible and manipulation causes the toy to wriggle and simulate the motion of a live snake or other animal.

The following patent references would appear to be germaine to the patentability of the present device:

| | |
|---|---|
| 2,241,576 Barton | 3,050,902 Glass et al |
| 2,453,646 Tomlin | 3,203,285 Schmidt |
| 2,853,831 Bischoff | 3,410,023 Anello |

Barton, Tomlin et al, and Bischoff all teach the use of a string or a cable in conjunction with a segmented body to simulate life-like motion. Tomlin et al teaches the use of a plurality of strings in conjunction with a string to draw tension and maintain the segmented toy in an erect posture until the tension is relieved by manipulation of the string and the toy takes on various postures. Likewise, Barton employs a series of strings when manipulated by hand cause the segmented body of the toy snake to move accordingly. Schmidt uses a cable with a threaded tensioner as the structural core of a segmented wrench handle that assumes various arcs in order to reach inaccessible nuts or bolts. The other references cited further delineate the state of the art.

The present device also uses a segmented core in conjunction with a cable, but in comparison a lever device that latches to maintain cable tension is disguised in the head of the body and when the tension is drawn the body becomes rigid and rectilinear and assumes the form of a walking stick or cane. When the cable tension is released the elastic skin covering the segmented body returns the device to a coiled snake-like posture because of a memory wired into the elastic membrane during its application to the segmented core. Other distinguishing characteristics will become evident when considering further the details of the present invention.

SUMMARY AND OBJECTS OF THE INVENTION

It is a primary object of this device to create the illusion that a walking staff can be transformed into a coiled serpent as Moses did for Pharaoh (Exodus 4:3). This is accomplished by providing two modes for the device. The first mode uses a segmented core in conjunction with a tensioned cable and a pivotal latching head to achieve the rigid walking staff or cane-like configuration. The second mode, that of a coiled serpent, is achieved by the memory wired into the elastic membrane skin covering the core.

Accordingly, it is an object of the present device to provide a magician with a prop he can use in conjunction with his performance.

It is a further object of the present device to accomplish either of the two above mentioned modes with a simple, quick, actuation provided by a quickly released latch so that the actuation is hidden from the viewer's eye.

Other objects and advantages will become apparent in the following specifications when considered in light of the attached drawings.

BRIEF DESCRIPTION OF THE DRAWINGS

FIG. 1 is a side view of the device in its cane mode.

FIG. 2 is a sectional view of the device in its snake mode.

FIG. 3 is a section side view of the latching head.

FIG. 4 is a bottom view of the latching head.

DESCRIPTION OF THE PREFERRED EMBODIMENT

Referring now to the drawings in detail wherein like reference characters indicate like parts throughtout the several figures, the reference numeral 10 refers generally to the pivoted latching head of the device and reference numeral 11 refers generally to the body of the device.

The head 10 is comprised of the upper head piece 12 and the lower jaw piece 13 which are decorated like a snake's head with an eye 14, a small forward tooth 26, and a larger rear tooth 27, the large tooth 27 joins lower and upper pieces 12 and 13 at a pivot pin 15 so that the two head pieces form a lever device to draw tension on the internal cable 23 which is firmly implanted in the upper head piece 12 at a point 24 where the head 10 joins the body 11. The lower jaw piece 13 is firmly implanted in the first neck segment 21 at an upper location 18. A latching arm 16 is affixed to the upper head piece by means of a pivot pin 17 located near the forward tooth 26. The lower jaw piece 13 is provided with a slot 19 through which the latching arm 16 travels and locks on the catch level notch 20 provided at the innermost extremity of the slot 19. Compressing the forward extremeties of the head pieces towards one another causes the upper head piece to pivot on the pin 15, separating from the first neck segment 21 and drawing tension on the internal cable 23. This tension can be maintained by latching the latching arm 16 in the catch bevel notch 20.

The body 11 of the device is comprised of a series of disc-like segments 22 with holes in the center that form the core of the device. The segments 22 may be consecutively smaller as they descend the core so that the overall body has a tapered appearance. The internal cable 23 runs freely through the center holes in the segments 22 and is firmly affixed to the last segment 26 and the upper head piece 12. In the relaxed mode the segments are separated by a discrete distance so that the core of the body may flex. In the rigid mode tension is drawn on the cable 23 by compressing the lever-like head 10 and the distance between the segments is closed so that the flat sides of the adjacent segments firmly abut one another and the entire core becomes rectilinear and rigid.

Surrounding the entire core and portions of the head is an elastic membrane 25 that gives the appearance of a skin covering the body. The skin 25 is applied to the core of the body when the body is in the relaxed, coiled mode with the head slightly raised. The skin is allowed to cure while the body is in the coiled posture so that it will retain a memory causing the device to always return to that coiled configuration when the cable tension is released and the device is in the relaxed, snake-like mode.

What is claimed is:

1. A snake shaped magician's cane convertible from a rigid to a non-rigid mode comprising in combination: a body having a central core formed from a plurality of disc elements interconnected by a cable extending through the centers of said discs so that the flat sides of said discs are juxtaposed one to the other, skin means having a memory overlying said core whereby said skin means forms a continuous shroud over said core having a tail at one extremity and a neck at another extremity, and latching means integral with a terminal portion of the cane formed as a snake's head and connected to said cable whereby when said latching means are deployed said cane takes a rigid form and when said latching means are disengaged said cane is non rigid and said memory of said skin means causes said cane to form a substantially coiled snake configuration.

2. The device of claim 1 wherein said latching means comprises: an upper head portion connected at one end of said cable 1 near the neck, a lower jaw portion connected to said neck underlying said upper head portion and pivoted thereto at medial portions thereof, and locking latch pinned to said upper head portion at an extremity opposed said cable whereby pivoting said upper head portion removes and pays out slack in said cable, said locking latch extends through said lower jaw portion locking thereto.

3. The device of claim 2 wherein said locking latch locks to said lower jaw by engagement of a hook on said latch to a notch on said jaw.

4. The device of claim 3 wherein said skin means is formed from soft elastic material taken from the group of rubber, neoprene and plastic and covers said body and head.

* * * * *